United States Patent [19]

VanDyke

[11] Patent Number: 5,031,693

[45] Date of Patent: Jul. 16, 1991

[54] JET IMPINGEMENT PLATE FIN HEAT EXCHANGER

[75] Inventor: John M. VanDyke, Rockford, Ill.

[73] Assignee: Sundstrand Corporation, Rockford, Ill.

[21] Appl. No.: 606,625

[22] Filed: Oct. 31, 1990

[51] Int. Cl.[5] ..... F28F 3/02

[52] U.S. Cl. ..... 165/166; 165/908

[58] Field of Search ..... 165/166, 907, 908

[56] References Cited

U.S. PATENT DOCUMENTS

| | | | |
|---|---|---|---|
| 3,033,536 | 5/1962 | Guszmann | 165/908 X |
| 3,568,462 | 3/1971 | Hoffman et al. | 165/165 X |
| 4,108,242 | 8/1978 | Searight et al. | 165/164 |
| 4,201,195 | 5/1980 | Sakhuja | 126/449 |
| 4,899,808 | 2/1990 | Gregory et al. | 165/1 |

FOREIGN PATENT DOCUMENTS

| | | | |
|---|---|---|---|
| 124335 | 10/1947 | Australia | 165/166 |
| 347548 | 9/1972 | U.S.S.R. | 165/166 |
| 499490 | 4/1976 | U.S.S.R. | 165/166 |

*Primary Examiner*—Allen J. Flanigan

*Attorney, Agent, or Firm*—Antonelli, Terry, Stout & Kraus

[57] ABSTRACT

A two-media laminated jet impingement heat exchanger comprising a heat exchanger core (1) including a plurality of soild heat exchanger or spacer plates (7) and a plurality of corrugated heat exchanger plates (8, 9) respectively interposed between and secured to the adjacent solid heat exchanger plates (7) so as to define between adjacent heat exchanger plates (7) second channels for respectively accommodating the two media. Each of the corrugated heat exchanger plates (8, 9) include a plurality of surface portions (8*a*, 9*a*) extending substantially parallel to one another. At least two rows of orifices (10) are provided in the surface portions of the corrugated heat exchanger plates (8) associated with one medium for enabling a flow of the one medium therethrough. At least one row of orifices (11) is provided in the surface portion of the heat exchanger plates (9) associated with the other medium of the two media for enabling a flow of the other media therethrough. The at least two rows of orifices (10) in the surface portions (8*a*) of the corrugated heat exchanger plates (8) are offset with respect to the corresponding rows in adjacent surface portions such that the one medium flows through the orifices and impinges on adjacent surface portions so as to define a tortuous flow path for the one medium through the respective channels associated with the one medium of the heat exchanger core (1).

14 Claims, 2 Drawing Sheets

JET IMPINGEMENT PLATE FIN HEAT EXCHANGER

DESCRIPTION

1. Technical Field

The present invention relates to a plate fin heat exchanger and, more particularly, to a laminated counterflow jet impingement plate fin heat exchanger.

2. Background Art

Plate fin heat exchangers have been proposed and find various applications in diverse fields and, for example, commonly assigned pending U.S. Application Ser. No. 315,829 and U.S. Pat. No. 4,880,055 respectively entitled "Crossflow Jet Impingement Heat Exchanger" and "Impingement Plate Type Heat Exchanger", each propose a heat exchanger construction utilizing a lap brazed joint to separate the two fluids from each other.

While each of the proposed constructions are highly efficient, fabrication development has demonstrated that with the lap brazed joint technique, taking into account the number of joints required as well as the desire to maintain thin joints so as to minimize weight, especially when the heat exchanger is to be used in the field of aircraft manufacturing, it is difficult to produce a heat exchanger which is leak tight between the fluids.

U.S. Pat. No. 2,616,671 provides another example of a plate heat exchanger wherein a series of sheet metal heat exchange plates having planar surfaces are arranged in parallel in face-to-face space relationship forming a series of fluid flow passages between the surfaces of adjacent plates. Each of the heat exchange plates is provided with port openings to permit an input and output of the flow to and from the passages. The port openings to alternate flow passages are serially interconnected to provide for a separated flow through the passages of two streams of fluid in a heat exchange relationship by conduction through the heat exchanger plates. A series of sheet metal plates are interposed between the heat exchanger plates within the flow passages, and the spacer plates have a series of parallel spaced corrugations formed in a central portion thereof inwardly of a plane marginal portion thereof and arranged transversely of the flow passages between the input and output port openings. The corrugations are offset alternately into opposite contact with the surfaces of adjacent heat exchange plates so as to define a succession of overlapping shallow flow channels underlying the corrugations along the surface of adjacent heat exchange plates. The intermediate portions of the spacer plates between the corrugations including a plurality of perforations successively interconnecting the flow channels.

With the last mentioned construction, a fluid flowing through the flow passage is subjected to a tortuous course repeatedly changing from one surface to the other of the spacer plate in alternating contact with adjacent heat exchanger plates, and the defining of the flow channels by corrugations coupled with the perforations connecting opposite adjacent channels attempt to maximize intermixing and turbulence in the fluid stream with a minimum pressure drop due to flow resistance.

U.S. Pat. No. 3,157,229 also proposes a plate heat exchanger for promoting turbulent flow, wherein a pair of generally parallel spaced heat exchange plates have a packing cord compressed therebetween along marginal portions thereof, with the plates and packing cord defining a longitudinal flow path for a fluid medium between the plates. The plates have spaced opposing surfaces formed with corrugations defining ridges and valleys extending generally transversely of the longitudinal flow path to provide the flow path with a wave-like form. A perforated plate member is disposed in the flow path and is releasably secured to one of the plates. The perforated plate member extends transversely of the ridges while substantially spanning the valleys of the corrugations of each opposing plate surface and has perforations positioned for flow of the fluid medium along the path in a zig-zag fashion alternately on one side and then the other side of the plate member.

As with the '671 patent, the last mentioned proposed construction attempts to promote turbulence in the flow of one of the fluid media; however, neither the last mentioned proposed construction nor the '671 patent propose providing any extended surfaces for the heat exchanging plates nor do the perforated plates contribute to heat transfer. In this connection, extended surfaces are essential to compact heat exchangers in that they provide large amounts of heat transfer surface area in small packages. Moreover, extended surfaces are important in balancing the heat transfer provided by each side of the heat exchanger.

In, for example, U.S. Pat. No. 3,151,675, yet another plate type heat exchange is proposed wherein a pack of spaced opposed plates are provided with each of the plates being in contact with adjacent plates at least partially along parallel spacing ridges which are integral with and project from one of the plates. The spaces between adjacent plates form a plurality of straight parallel channels for a flow of gaseous heat exchanging fluid between adjacent plates, with each channel having spaced side walls formed by confronting portions of adjacent plates and lateral walls formed at least partially by adjacent ridges. A plurality of furrows extend obliquely across and integral with at least one of the confronting side walls forming the side walls of each of the channels.

The last mentioned patented construction attempts to improve heat transfer between the fluid in motion and the surface by providing disturbances of flow in the passage for the fluid to remove or thin the boundary layer extending along a surface of the heat exchanger plate. The proposed plate-fin heat exchanger does not have any perforations, fluid jets or extended surfaces and, consequently, cannot achieve the significantly higher heat transfer attained with an impingement plate fin heat exchanger.

U.S. Pat. No. 3,568,462, proposes a fractionating apparatus including parallel vertical metal partitions between which is arranged the fractionating unit, with the fractionating unit including a corrugated metal sheet having substantially square corrugations. Adjacent surfaces of the corrugations are substantially at a 90° angle with respect to each other. Longitudinally extending alternate vertical sides of the corrugated sheet are disposed in contact with surfaces of the opposite partitions or walls and are attached thereto. The corrugated metal sheet forms a series of vertically disposed partitions or plates positioned in parallel substantially horizontal positions. Each of the horizontal plates or partitions of corrugated sheets includes a plurality of perforations or holes to permit an upward passage of vapor from a space below one partition to a space above the partition. The perforations are uniformly distributed in a relatively close proximity to each other over the surface of the partitions and can be arranged in rows the with perforations in adjacent rows being offset with respect to each other.

In the last mentioned patented construction, a device is provided for fractionating a vapor mixture, with a liquid film flowing downwardly through the perforations coming into direct contact with a vapor or vapor mixture flowing upwardly through the perforations. Through this contact, gaseous mixtures are separated into their individual components thus, the patented construction utilizes the perforations or openings to enhance the contact of two fluids flowing in opposite directions rather than a single fluid for creating a jet which impinges upon a subsequent heat exchange surface.

DISCLOSURE OF INVENTION

The aim underlying the present invention essentially resides in providing a laminated two-fluid jet impingement heat exchanger which ensures very high jet impingement heat transfer coefficients so as to allow a significant reduction in size and weight over a comparable performing plate-fin heat exchanger, and which enables the formation of thin joints while nevertheless maintaining a leak-tight relationship between the two fluids of the heat exchanger.

In accordance with advantageous features of the present invention, a two-media laminated jet impingement heat exchanger is provided which includes a heat exchanger core having a plurality of solid heat exchanger or spacer plates, and a plurality of corrugated heat exchanger plates respectively interposed between and secured to adjacent solid heat exchanger plates so as to define between the adjacent solid heat exchanger plates separate channels for respectively accommodating the two media. The channels are arranged such that the flow of the respective media through the heat exchanger core alternate. Each of the corrugated heat exchanger plates includes a plurality of surface portions which extend substantially parallel to one another, and at least two rows of orifice means are provided in the surface portions of the corrugated heat exchanger plates associated with the one medium for enabling a flow of the one medium therethrough. At least one row of orifice means is provided in the surface portions of the heat exchanger plates associated with the other of the two media for enabling a flow of the other media therethrough. The at least two rows of orifice means in the surface portions of the corrugated heat exchanger plates associated with the one medium are offset with respect to the corresponding rows in adjacent surface portions of the corrugated heat exchanger plates such that the one medium flows through the orifice means and impinges on the adjacent surface portions so as to define a tortuous flow path for the one medium through the respective channels of the heat exchanger core.

In accordance with the present invention, the at least one row of orifice means provided in the surface portions of the corrugated heat exchanger plates associated with the other medium have a larger cross-sectional configuration than a cross-sectional configuration of the orifice means with the at least two rows of orifice means associated with the one medium of the two media.

The at least one row of orifice means of the respective surface portions of the other medium are disposed substantially in alignment so as to permit a substantial unimpeded flow of the second medium through the heat exchanger core. However, it is also possible for the at least one row of orifice means associated with the other medium to be offset with respect to the corresponding row in adjacent surface portions of the corrugated heat exchanger plates so that the other medium flows through the orifice means and impinges on the adjacent surface portions thereby defining a tortuous flow path for the other medium through the respective channels of the heat exchanger core associated with the other medium.

The channels associated with the respective media may extend substantially parallel to one another throughout the heat exchanger core or may be arranged such that the channels associated with the respective media are disposed substantially at a right angle with respect to each other.

The above and other objects, features, and advantages of the present invention will become more apparent from the following description when taken in connection with the accompanying drawings which show, for the purpose of illustration only, one embodiment in accordance with the present invention.

BEST MODE FOR CARRYING OUT THE INVENTION

Figure 1:
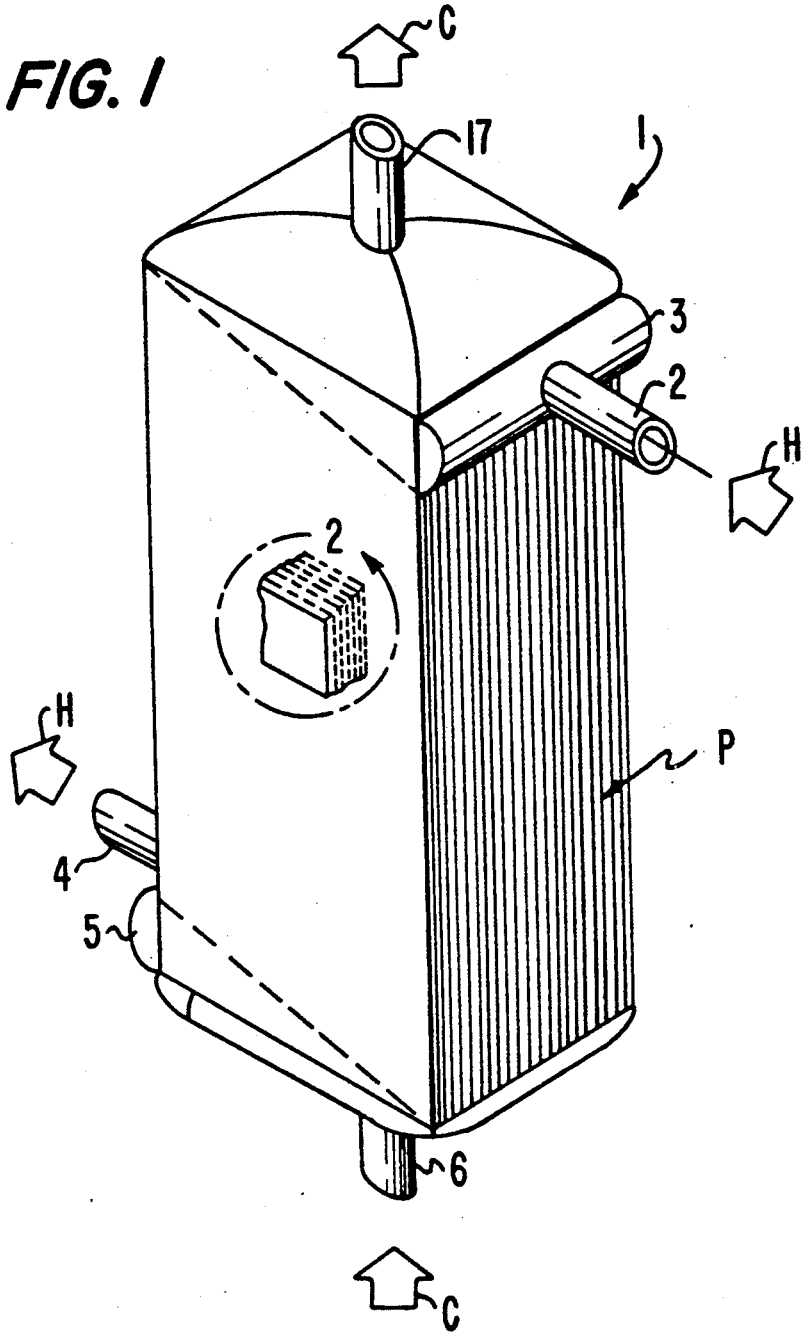
FIG. 1 is a schematic perspective view of a laminated counter flow jet impingement plate fin heat exchanger constructed in accordance with the present invention.

Referring now to the drawings wherein like reference numerals are used in both views to designate like parts and, more particularly, to FIG. 1, according to this figure, a two-media counter flow laminated jet impingement plate fin heat exchanger includes a heat exchanger core generally designated by the reference numeral 1 comprising a plurality of heat exchanger plates generally designated by the reference character P, a first medium inlet pipe or stub 2, a first fluid inlet manifold or header 3, a first medium discharge or outlet manifold or header 5, and a first medium outlet pipe or stub 4. A second or cross-flow medium is supplied through an inlet pipe or stub 6 and flows through the heat exchanger core I, with the second medium being discharged through an outlet or discharge pipe or stub !7. The first and second media may, for example, be single phase fluids and, in FIG. 1 the first fluid is a hot fluid, the flow of which is designated by the arrow H, with the second fluid being a cold fluid, the flow of which is designated by the arrow C.

Figure 2:
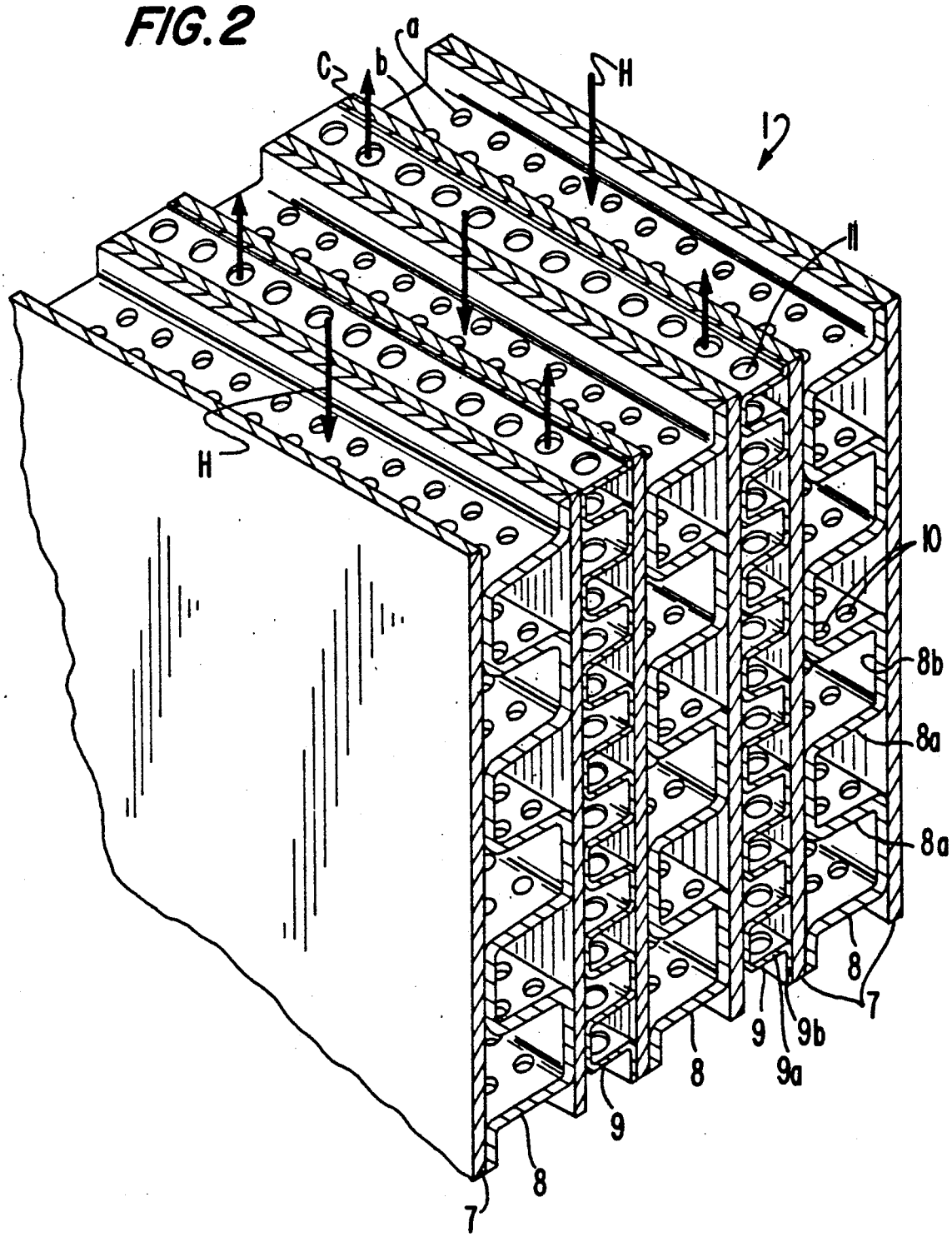
FIG. 2 is a cross-sectional configuration of an internal portion of the laminated counterflow jet impingement plate fin heat exchanger taken along the section line 2 in FIG. 1.

As shown most clearly in FIG. 2, the plurality of heat plates exchanger include a plurality of substantially planar solid or unperforated spacer or separator plates 7 having interposed therebetween corrugated fin plates 8, 9. In the illustrated embodiment, the fin plates 8 are provided with a plurality of orifices or openings !0 arranged in two aligned rows with the fin plates 8 being provided with a single row of aligned orifices or openings 11. The number of rows of openings or orifices 10, 11 in each of the fin plates 8, 9 may vary in dependence upon, for example, the nature of the fluid between which the heat exchange is to be effected, the desired heat exchanging characteristics, the particular uses of the heat exchanger, the nature of the material of the corrugated fin plates 8, 9 and/or the desired size of the heat exchanger core Thus, for example, the corrugated fin plate 9 may be provided with a single aligned row of orifices or openings 11, with the corrugated fin plate 8 being provided with a pair of rows of orifices or openings 10 or two or more rows of orifices or openings 10, may be provided in the respective corrugated fin plates 8, 9. Additionally, while the orifices or openings 10, 11 and the respective corrugated fin plates are depicted as having a circular configuration, it is understood that the configurations of the orifices or openings 10, 11 may be rectangular, oval or slot-shaped in dependence upon the particular fluids, desired application, and/or desired heat exchange capabilities.

As shown in FIG. 2, the tines or legs 8*a*, 9*a*, of the respective corrugated fin plates 8, 9 are disposed substantially at a right angle with respect to the associated spacer or separator plates 7 and are spaced from each other in a direction of the flow H, C of the respective fluids. In the illustrated embodiment the orifices or openings 11 have a larger cross-sectional configuration than the orifices or openings 10, and the orifices or openings 10 in the successive tines 8 of the respective corrugated fin plates 8 are offset or staggered with respect to each other to cause impingement of jets of fluid produced by each orifice on a heat conductive surface of the subsequent tine 8*a* located between adjacent orifices 10. After impingement of each jet of fluid on a surface of a subsequent tine 8*a*, the fluid migrates along the subsequent tine 8*a* to an opening or orifice 10 through which the fluid then passes, with the fluid continuing to pass through the orifices or openings 10, along a tortious path until being discharged from the heat exchanger core through the discharge pipe or stub 4. The respective corrugated fin plates 8, 9 are secured to adjacent associated spacer or separator plates 7 along bite portions 8*b* or 9*b* by suitable processing such as, for example, brazing or the like. In the illustrated embodiment, the respective flows H, C of the two fluids are illustrated as being parallel to each other through the heat exchanger core; however, it is also possible in accordance with the present invention for the corrugated fin plates 8 or 9 to be reoriented or shifted by 90° such that the respective fluids flow through the heat exchanger core 1 at right angles with respect to each other.

In the illustrated embodiment the orifices or openings 11 in the successive tines 9*a* are disposed in substantial alignment so as to permit a substantially unimpeded flow of the fluid through the heat exchanger core 1; however, the rows of orifices or openings 11 in the adjacent tines 9*a* may be stopped or offset with respect to each other so as to also define a tortuous path for the fluid. Moreover, depending upon the particular application of specifications of the heat exchanger, two or more rows of orifices or openings 11 may be provided with the two or more rows of orifices or openings 11 in the adjacent tines 9*a* either being in substantial alignment or staggered with respect to each other.

The heat exchanger core 1 utilizes corrugated fin stock between the spacer or separator plates 7, with the fin stock being formed in a conventional manner with the exception of the orifices or openings 10, 11 fluid jet passing through the respective orifices or openings 10, 11 and impinging on the subsequent surfaces of the tines 8*a*, 9*a* results in a much higher heat transfer coefficient than forced convection along the fin which method is presently used in regular plate-fin heat exchangers. The enhanced heat transfer results in less fin area being required and hence a lower weight and volume than a normal plate-fin heat exchanger.

In the heat exchanger construction of the present invention, each fluid, liquid or gas passes through alternate layers of the fin stock and is prevented from mixing by the spacer or separator plates 7 thereby eliminating any leakage problems encountered in previous laminated jet impingement heat exchanger constructions.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A two-media laminated jet impingement heat exchanger comprising a heat exchanger core including a plurality of solid heat exchanger plates, a plurality of corrugated heat exchanger plates respectively interposed between and secured to adjacent solid heat exchanger plates so as to define between adjacent heat exchanger plates separate channels for respectively accommodating the two media, said channels being arranged in the heat exchanger core such that the flows of the respective medium through the heat exchanger core alternate, each of said corrugated heat exchanger plates including a plurality of surface portions extending substantially parallel to one another, at least two rows of orifice means provided in the surface portions of the corrugated heat exchanger plates associated with one medium of the two media for enabling a flow of said one medium therethrough, at least one row of orifice means provided in the surface portions of the corrugated heat exchanger plates associated with the other medium of the two media for enabling a flow of said other media therethrough, and wherein said at least two rows of orifice means in said surface portions of the corrugated heat exchanger plates associated with said one medium are offset with respect to corresponding rows in adjacent surface portions such that said one medium flows through the orifice means of said at least two rows of orifice means and impinges on adjacent surface portions of the corrugated heat exchanger plates thereby defining a tortuous flow path for said one medium through the respective channels of the heat exchanger core.

2. A two-media laminated jet impingement heat exchanger according to claim 1, wherein the at least one row of orifice means provided in the surface portions of the corrugated heat exchanger plates associated with said other medium has a larger cross-sectional configuration than a cross-sectional configuration of the orifice means of said at least two rows of orifice means.

3. A two-media laminated jet impingement heat exchanger according to claim 2, wherein said at least one row of orifice means of the respective surface portions are disposed substantially in alignment so as to permit substantially unimpeded flow of the other medium through the orifice means of the respective surface portions.

4. A two-media laminated jet impingement heat exchanger according to claim 3, wherein said channels for the two media extend substantially parallel to one another throughout the heat exchanger core.

5. A two-media laminated jet impingement heat exchanger according to claim 3, wherein said channels for the two fluid media are arranged such that the channels associated with said one medium are disposed substantially at a right angle to the channels associated with said other medium.

6. A two-media laminated jet impingement heat exchanger according to claim 1, wherein each of said surface portions of said corrugated heat exchanger plates extends substantially at a right angle with respect to said solid heat exchanger plate.

7. A two-media laminated jet impingement heat exchanger according to claim 6, wherein the at least one row of orifice means provided in the surface portions of the corrugated heat exchanger plates associated with said other medium has a larger cross-sectional configuration than a cross-sectional configuration of the orifice means of said at least two rows of orifice means.

8. A two-media laminated jet impingement heat exchanger according to claim 7, wherein said at least one row of orifice means of the respective surface portions are disposed substantially in alignment so as to permit substantially unimpeded flow of the other medium through the orifice means of the respective surface portions.

9. A two-media laminated jet impingement heat exchanger according to claim 8, wherein said channels for the two media extend substantially parallel to one another throughout the heat exchanger core.

10. A two-media laminated jet impingement heat exchanger according to claim 6, wherein said channels for the two fluid media are arranged such that the channels associated with said one medium are disposed substantially at a right angle to the channels associated with said other medium.

11. A two-media laminated jet impingement heat exchanger according to claim 1, wherein the at least one row of orifice means provided in the surface portion of the corrugated heat exchanger plate associated with said other medium are offset with respect to a corresponding at least one row of orifice means in adjacent surface portions such that the other medium flows through the orifice means and impinges on adjacent surface portions so as to define a tortious flow path for the other medium through the respective channels of the heat exchanger core associated with the other medium.

12. A two-media laminated jet impingement heat exchanger according to claim 11, wherein the at least one row of orifice means provided in the surface portions of the corrugated heat exchanger plates associated with said other medium has a larger crosssectional configuration than a cross-sectional configuration of the orifice means of said at least two rows of orifice means.

13. A two-media laminated jet impingement heat exchanger according to claim 12, wherein said channels for the two media extend substantially parallel to one another throughout the heat exchanger core.

14. A two-media laminated jet impingement heat exchanger according to claim 11, wherein said channels for the two fluid media are arranged such that the channels associated with said one medium are disposed substantially at a right angle to the channels associated with said other medium.

* * * * *